US009597866B2

(12) United States Patent
Bicego et al.

(10) Patent No.: US 9,597,866 B2
(45) Date of Patent: Mar. 21, 2017

(54) INKING DEVICE FOR PRINTING MACHINES

(71) Applicant: UTECO CONVERTING S.p.A., Colognola Ai Colli (IT)

(72) Inventors: Alessandro Bicego, Oppeano-Frazione Vallese (IT); Federico Albrigi, Verona (IT); Massimo Resentera, Verona (IT); Stefano Russo, Folgaria (IT)

(73) Assignee: UTECO CONVERTING S.P.A., Colognola Ai Colli (IT)

( * ) Notice: Subject to any disclaimer, the term of this patent is extended or adjusted under 35 U.S.C. 154(b) by 0 days.

(21) Appl. No.: 14/427,453

(22) PCT Filed: Sep. 11, 2013

(86) PCT No.: PCT/IB2013/058451
§ 371 (c)(1),
(2) Date: Mar. 11, 2015

(87) PCT Pub. No.: WO2014/041484
PCT Pub. Date: Mar. 20, 2014

(65) Prior Publication Data

US 2015/0246527 A1 Sep. 3, 2015

(30) Foreign Application Priority Data

Sep. 13, 2012 (IT) ..... VR2012A0185

(51) Int. Cl.
*B41F 31/06* (2006.01)
*B41F 31/02* (2006.01)

(52) U.S. Cl.
CPC ..... *B41F 31/06* (2013.01); *B41F 31/027* (2013.01)

(58) Field of Classification Search
CPC ..... B41F 31/027; B41F 31/08; B41F 31/06; B41F 31/02; B05C 11/04
See application file for complete search history.

(56) References Cited

U.S. PATENT DOCUMENTS 5,031,529 A * 7/1991 Greenwood ..... B41F 31/08 101/142
5,088,402 A * 2/1992 Hycner ..... B41F 31/08 101/142

(Continued)

FOREIGN PATENT DOCUMENTS

CN 2778567 Y 5/2006
CN 101054012 A 10/2007

(Continued)

OTHER PUBLICATIONS

International Search Report and Written Opinion dated Dec. 13, 2013 issued in PCT/IB2013/058451.

(Continued)

*Primary Examiner* — Blake A Tankersley
*Assistant Examiner* — Leo T Hinze
(74) *Attorney, Agent, or Firm* — Scully, Scott, Murphy & Presser, P.C.

(57) ABSTRACT

An inking device for printing machines that comprises an inking body which is designed to be arranged so as to face the lateral surface of an anilox roller and forms an inking chamber that is open toward the anilox roller and has at least one inlet for introducing the ink into the inking chamber and at least one outlet for the exit of the ink from the inking chamber, and control elements that are adapted to vary the passage opening of the or of each outlet as a function of the pressure of the ink in the inking chamber.

5 Claims, 9 Drawing Sheets

(56) References Cited

U.S. PATENT DOCUMENTS

| | | | | |
|---|---|---|---|---|
| 6,655,280 | B2 * | 12/2003 | Cartellieri | B41F 31/027 101/350.6 |
| 9,044,776 | B2 * | 6/2015 | Riga, Jr. | B05C 11/04 |
| 2012/0210891 | A1 | 8/2012 | Masuch et al. | |
| 2014/0182701 | A1 * | 7/2014 | Sugimoto | B05C 1/0813 137/82 |

FOREIGN PATENT DOCUMENTS

| | | | |
|---|---|---|---|
| DE | 102009046078 | A1 | 5/2011 |
| EP | 1389523 | A1 | 2/2004 |

OTHER PUBLICATIONS

Chinese Office Action dated Jan. 18, 2016 received in Chinese Application No. 201380047875.0, together with an English-language translation.

* cited by examiner

INKING DEVICE FOR PRINTING MACHINES

The present invention relates to an inking device for printing machines.

As is known, printing machines and, in particular, flexographic printing machines have a plurality of color units, each one of which is provided with an inking device the function of which is to transfer the ink onto the lateral surface of an anilox roller, which is provided with a plurality of cells the function of which is to hold the ink on the anilox roller.

Each color unit is completed by a plate cylinder, which is arranged adjacent to the anilox roller and is designed to produce the print on the medium to be printed on.

Typically, the inking device comprises a doctor assembly, which is constituted by an inking body facing the lateral surface of the anilox roller.

Such inking body longitudinally forms an inking chamber, which in technical jargon is also called a doctor chamber.

In particular, the inking chamber is open in the direction of the anilox roller and is delimited, above and below, by a pair of doctor blades, which are mounted inclined, in mutually opposite directions, with respect to the lateral surface of the anilox roller on the inking body and which are designed to engage, with a sliding contact, the lateral surface of the anilox roller.

The inking process in each color unit occurs in the following manner.

The ink, by way of an adapted closed circuit, is transferred to the inking chamber, so that it can be transferred onto the anilox roller, filling the cells arranged on the lateral surface of the anilox roller.

The doctor blades ensure an optimal filling of the cells of the anilox roller, in that the "negative" blade, i.e. the one inclined in the direction opposite to the direction of rotation of the anilox roller, scrapes off the ink that did not enter the cells but instead remained on the lateral surface of the anilox roller, while the "positive" blade, i.e. the one inclined in the same direction as the direction of rotation of the anilox roller, ensures that the ink is kept inside the inking chamber.

The anilox roller subsequently transfers the ink contained in its surface cells to the plate cylinder, which thus performs the printing on the medium.

In the flexographic inking process, an essential role is played by the pressure of contact between the doctor blades and the lateral surface of the anilox roller.

In order to be able to ensure the correct pressure between the doctor blades and the anilox roller, control of the system for moving and supporting the inking device is important.

However, the system for pumping the ink into the inking chamber can also influence the pressure of contact between the doctor blades and the anilox roller.

Currently, a pneumatic double-membrane pump is commonly used to transfer the ink from its storage tank to the inking chamber, and a pneumatic double-membrane pump is used to pump the ink from the inking chamber in order to transfer it back to the storage tank.

A drawback of the known art consists in the fact that, under certain conditions, during the printing process, there can be an uneven wetting of the anilox roller over its whole width, with consequent onset of visible print defects and losses of ink at the doctor blade intended to contain the ink in the inking chamber.

In fact, the use of pneumatic double-membrane pumps in place of electric pumps, as in the past, has, on the one hand, solved considerable problems, such as the problem of safety in explosive environments and the ability to use pumps to suck from the inking chamber, but on the other hand involves a pulsing flow of ink, which determines a cyclic variation of the pressure inside the inking chamber with consequent variation of the pressure between the doctor blades and the anilox roller.

Furthermore, if the system for moving and supporting the inking device is not perfectly rigid, there will be a movement of the same during the cycle of variation of the pressure in the inking chamber, with a further variation of the pressure of contact between the doctor blades and the anilox roller.

The end effect of this pressure variation is an uneven and non-homogeneous filling of the cells of the anilox roller and, as a consequence, a non-optimal print result and possible losses of ink from the doctor chamber.

The aim of the present invention is to provide a solution to the drawbacks of the known art, by providing an inking device that is capable of maintaining the pressure of contact between the doctor blades and the anilox roller which is as constant as possible.

Within this aim, an object of the present invention is to prevent or, at least greatly limit, any variations of pressure inside the doctor chamber, even in the presence of strongly pulsing flows of ink.

Another object of the present invention is to provide an inking device that is capable of offering the highest guarantees of safety and reliability of use.

Another object of the present invention is to provide an inking device that is simple in terms of construction and low-cost.

This aim and these and other objects which will become more apparent hereinafter are all achieved by an inking device, according to the invention, as defined in claim 1.

Further characteristics and advantages of the invention will become more apparent from the description of some preferred, but not exclusive, embodiments thereof, illustrated by way of non-limiting example in the accompanying drawings wherein.

Figures 14, 15:
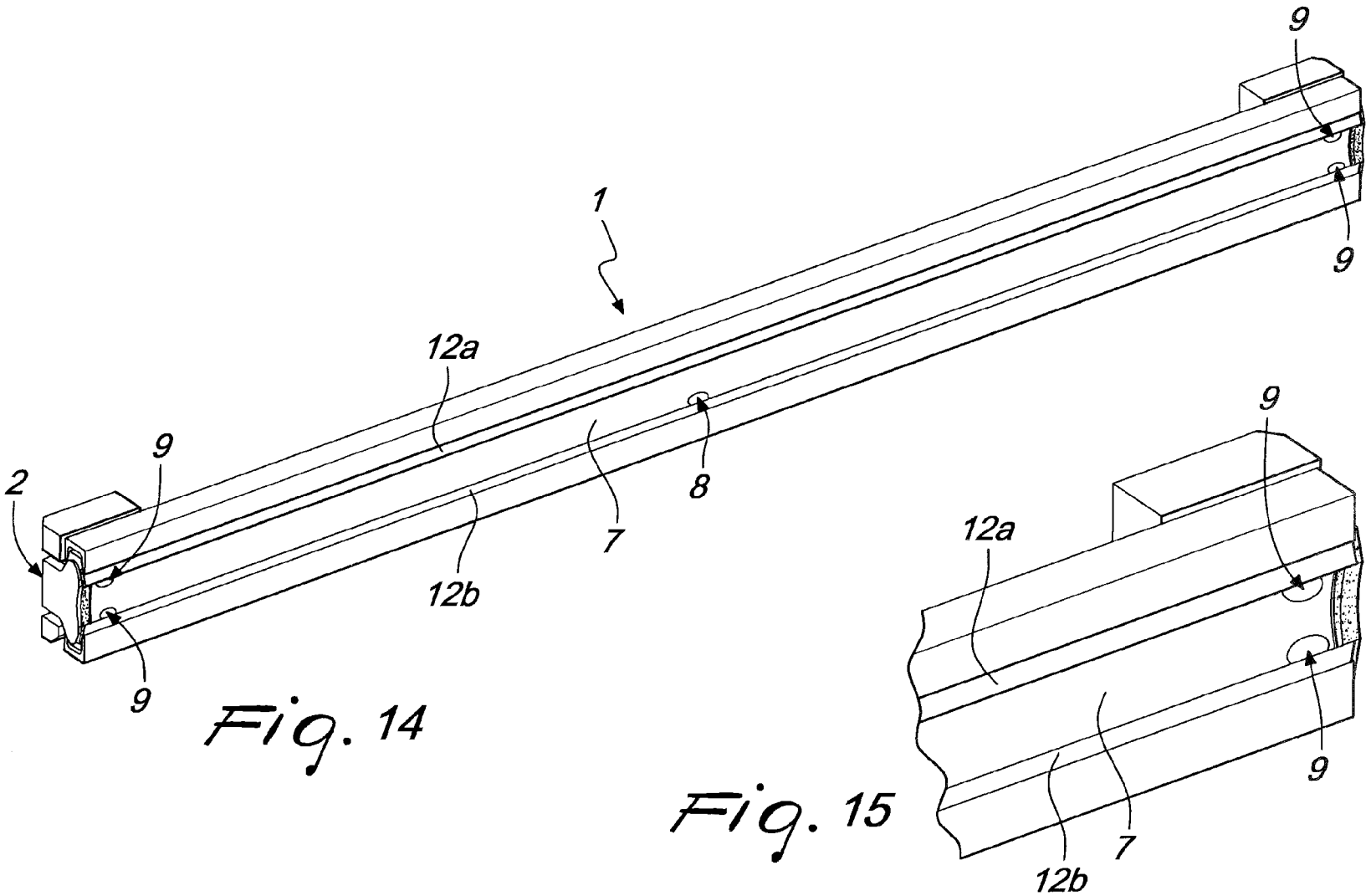
FIG. 14 is a perspective view of another possible variation of embodiment of the inking device according to the invention.
FIG. 15 is a detail of the variation of embodiment in FIG. 14.
Figure 16:
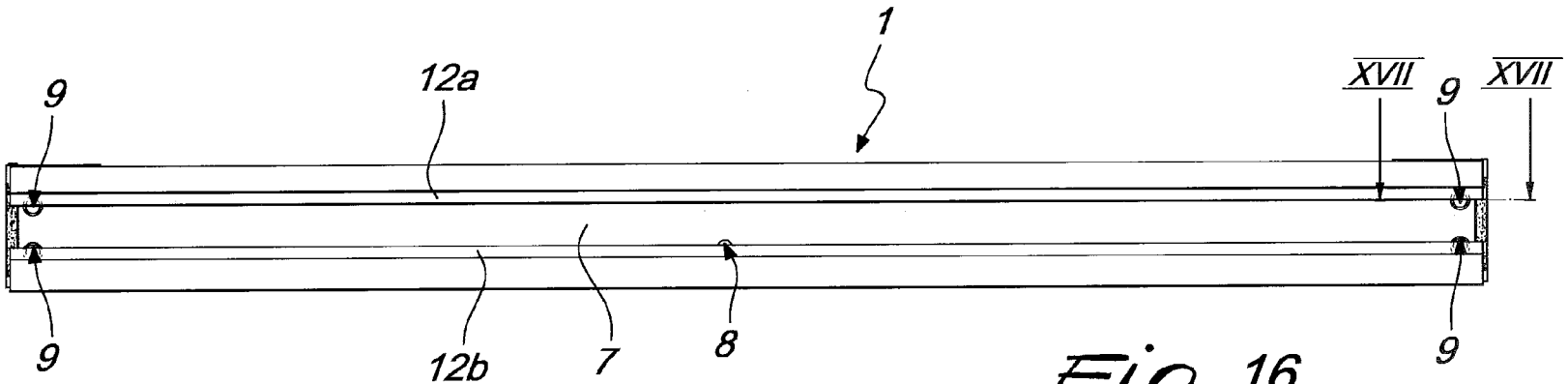
FIG. 16 is a front elevation view of the variation of embodiment in FIG. 14.
Figure 17:
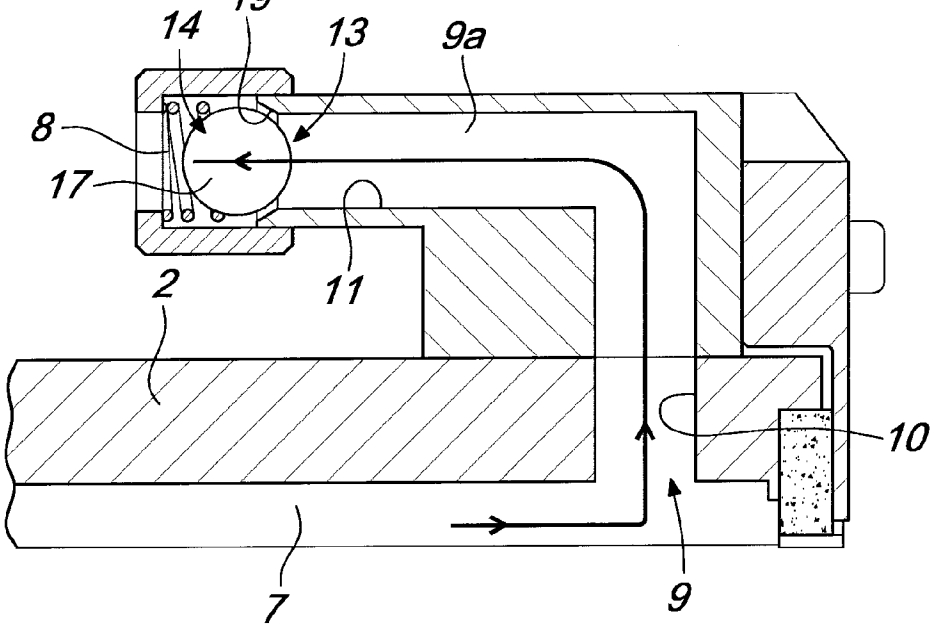

FIG. 17 is a cross-section along the line XVII-XVII in FIG. 14. With reference to the figures, the inking device, according to the invention, generally indicated with the reference numeral 1, comprises an inking body 2 which is designed to be arranged so as to face the lateral surface of an anilox roller 3.

Figure 1:
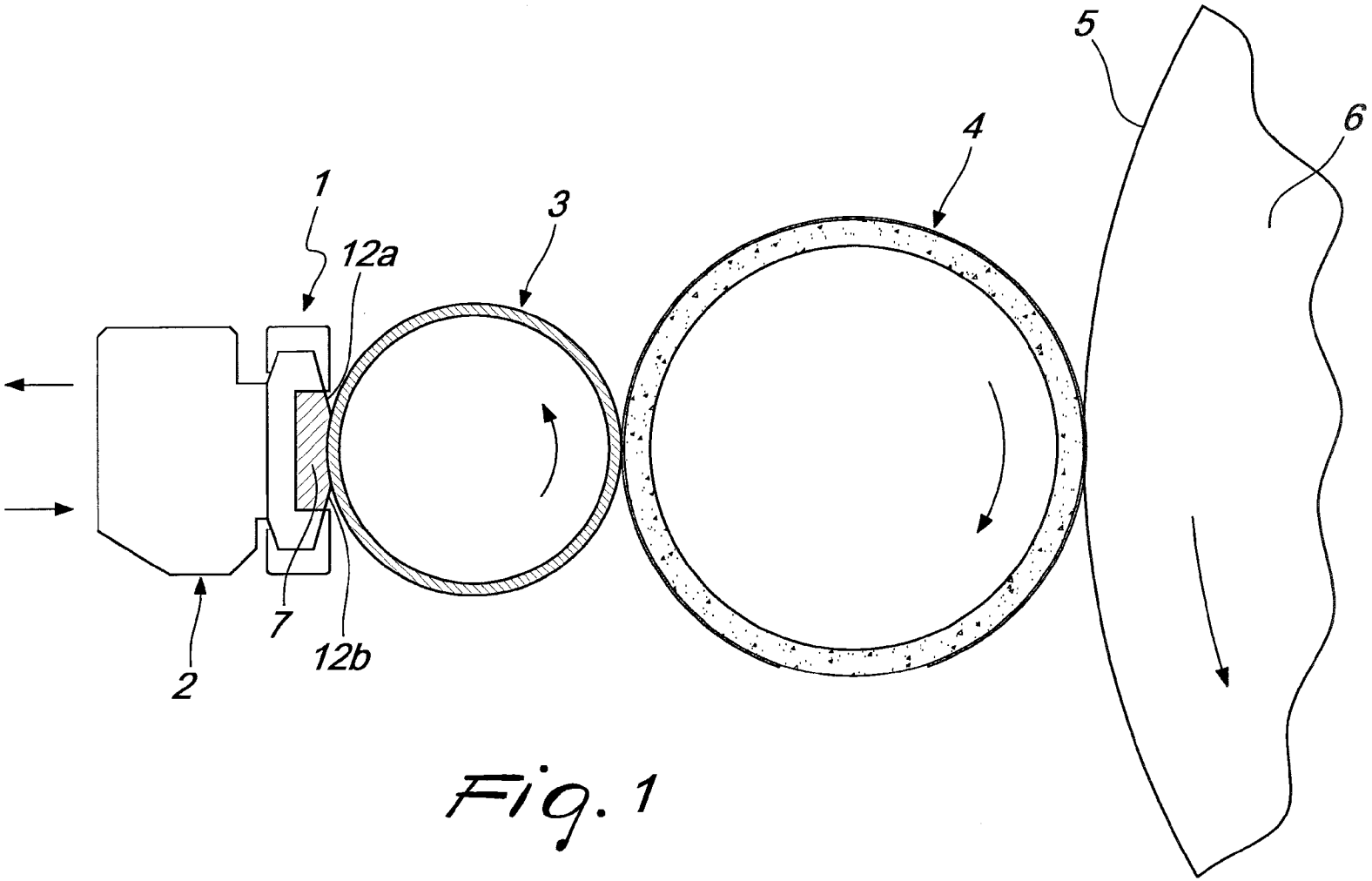
FIG. 1 is a schematic side view of a color unit of a printing machine of the flexographic type.
Figures 2, 3:
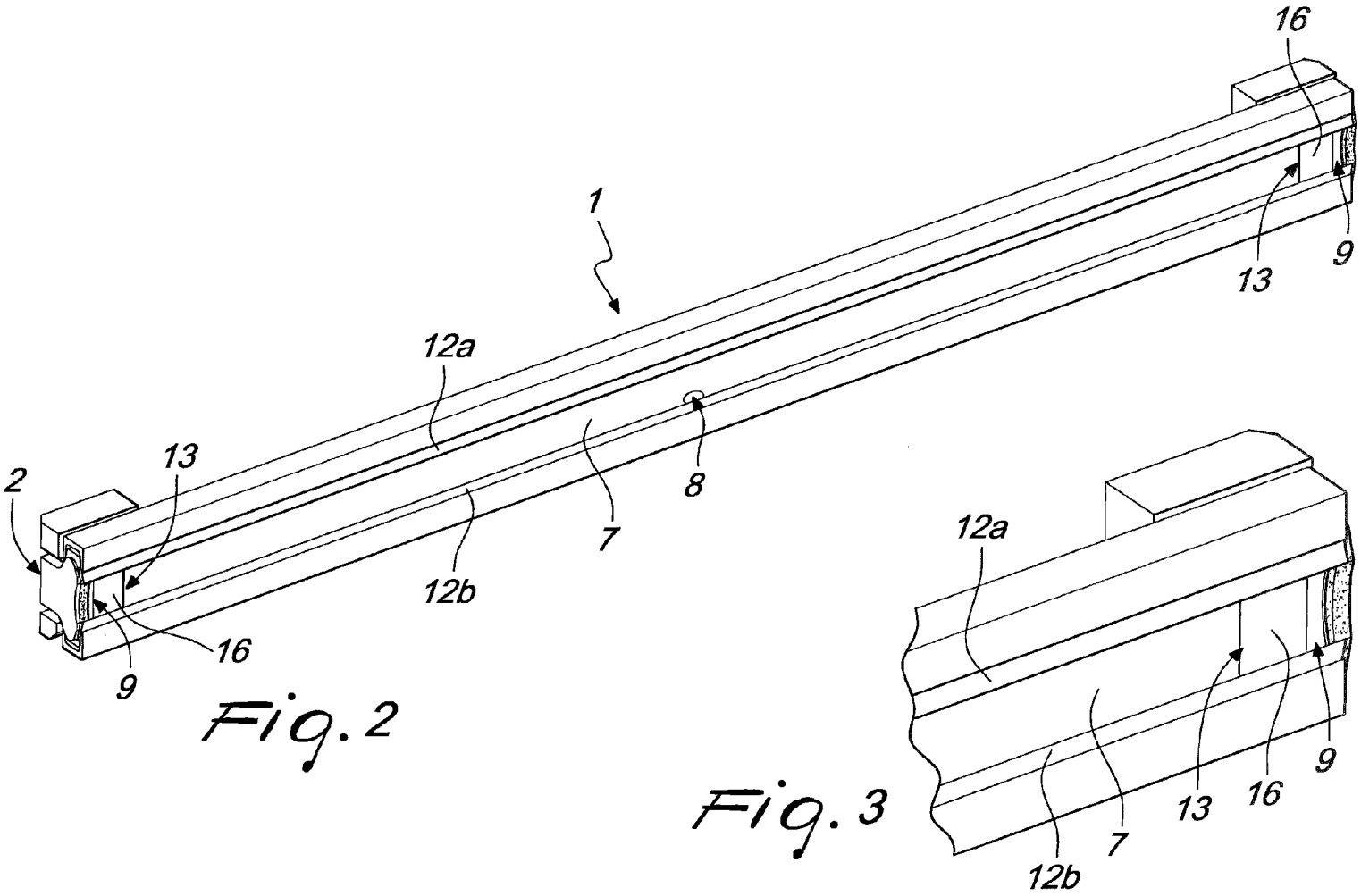
FIG. 2 is a perspective view of a first embodiment of the inking device according to the invention.
FIG. 3 is a detail of the embodiment in FIG. 2.
Figure 4:
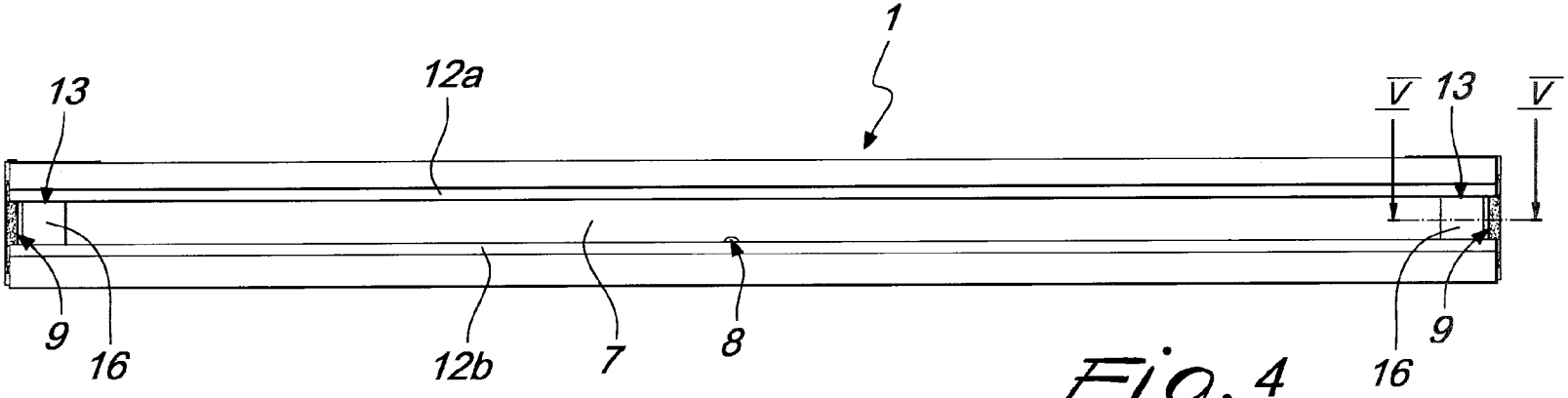
FIG. 4 is a front elevation view of the embodiment in FIG. 2.

As can be seen in FIG. 1, the anilox roller 3 is, in turn, adjacent, in a manner that is known per se, to a plate cylinder 4 which is designed to print the ink on a medium 5 which is driven by a drum 6.

The inking body 2 forms an inking chamber 7 that is open toward the anilox roller 3 and is provided with at least one inlet 8, through which the ink is introduced into the inking chamber 7, and one or more outlets 9, through which the ink can exit from the inking chamber 7.

Conveniently, the inking chamber 7 has a longitudinal extension that is substantially parallel to the axis of the anilox roller 3.

Preferably, substantially at each one of the longitudinal ends of the inking chamber 7, there is at least one respective ink outlet 9, while the ink inlet 8 is arranged in an intermediate position along the longitudinal extension of the inking chamber 7.

The inlet 8 and the outlets 9 of the inking chamber 7 are connected to an ink supply circuit, not shown, which, as is normal in the known art, can be provided with at least one pulsatile-flow supply pump, such as, for example, a pneumatic double-membrane pump, which provides the circulation of the ink between the tank for storing the ink in the printing machine and the inking chamber 7.

As can be seen in the examples shown, each outlet 9 can be, conveniently, constituted by a discharge opening 10, which is formed through the inking body 2 and which communicates with a siphon-shaped discharge channel 11, which lies on the side of the inking body 2 opposite to the one directed toward the anilox roller 3 from which the ink is sucked.

As is normal, mounted on the inking body 2 are furthermore, in a way that is known per se, at least one pair of doctor blades 12*a* and 12*b*, which are arranged on mutually opposite sides with respect to the longitudinal extension of the inking chamber 7 and which are designed to engage by contact, with a longitudinal edge thereof, with the lateral surface of the anilox roller 3.

The particularity of the invention consists in the fact that means 13 are provided for controlling the outlets 9 of the inking chamber 7, which are adapted to vary, in at least one region, the passage opening 9*a* of the outlets 9 of the inking chamber 7 as a function of the pressure of the ink inside the inking chamber itself.

In particular, such control means 13, in response to a possible variation of the inner pressure of the inking chamber 3 with respect to a reference value considered correct for a good level of print quality, are automatically able to vary, for example in shape and/or in size, the passage opening 9*a* of the outlets 9, consequently modifying their permeability, so as to maintain the pressure inside the chamber permanently at the aforementioned reference value.

In essence, thanks to the control means 13, if there is an overpressure of the ink inside the inking chamber 7, with respect to a reference value considered correct, for example owing to the pulsing flow of the ink into the inking chamber 7, an increase occurs in the size of the passage opening 9*a* of the outlets 9 which makes it possible to keep the pressure in the inking chamber 7 unchanged.

Similarly, in the event of a decrease of the pressure inside the inking chamber 7, which could occur between one pulsation and the next of the ink flow into the inking chamber 7, the aforementioned control means 13 will cause a reduction of the passage opening 9*a* of the outlets 9, with the consequence that the pressure inside the inking chamber 7 is maintained more or less unchanged.

By maintaining the pressure inside the inking chamber 7 practically constant, the inking device itself will be free from movements, so that the pressure of contact between the doctor blades 12*a* and 12*b* will remain, in turn, stable and, as a consequence, the inking will be optimal.

Going now into details, the control means 13 comprise, conveniently, at least one flow control element 14 which is arranged at the respective outlet 9 and can move, with respect to the inking body 2, between a position for opening the corresponding outlet 9 and a position for at least partially closing the corresponding outlet 9.

Advantageously, the movement of the flow control element 14 between the open position and the closed position of the corresponding outlet 9 can be controlled by elastic return means.

With reference to a first embodiment shown in FIGS. 2 to 5, the flow control element 14 can be constituted by a lamina 15, elastically flexible, which, at one of its ends, is fixed to the inking body 7 and which cantilevers toward the passage opening 9*a* of the respective outlet 9.

Conveniently, the lamina 15 can be made of plastic material, for example polyethylene, and is, advantageously, structured so as to almost perfectly cover the passage opening 9*a* of the corresponding outlet 9.

Again with reference to the embodiment in FIGS. 2 to 5, at each ink outlet 9, there can be a redirection wall, which is constituted, for example, by a latten 16. In particular, such a redirection wall extends substantially parallel to the longitudinal extension of the inking chamber 7 and its function is to force the ink that flows inside the inking chamber 7 to travel along the entire length of the inking chamber 7 before reaching the outlets 9, so as to ensure the complete filling of the cells of the anilox roller 3 even in its end regions, which, being near the outlets 15, could be more difficult to fill.

Figure 5:
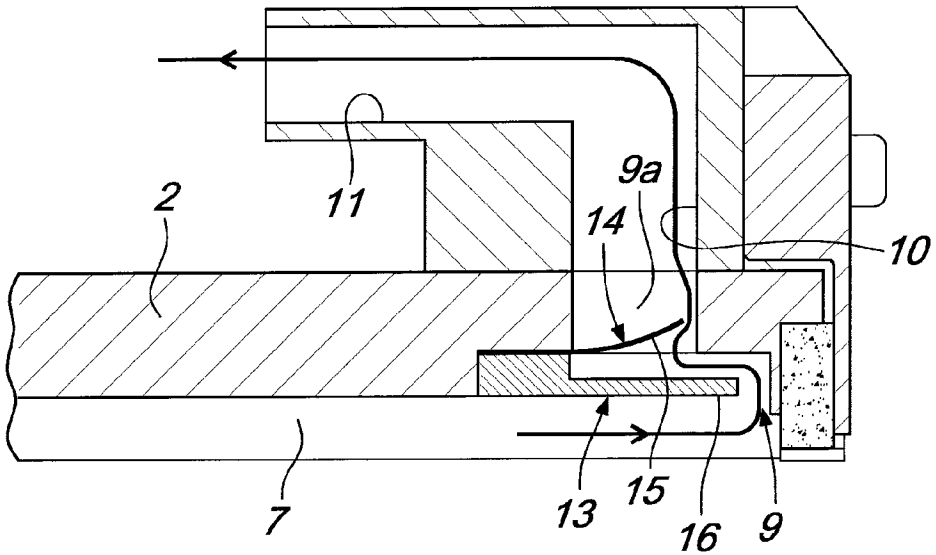
FIG. 5 is a cross-section along the line V-V in FIG. 4.
Figures 6, 7:
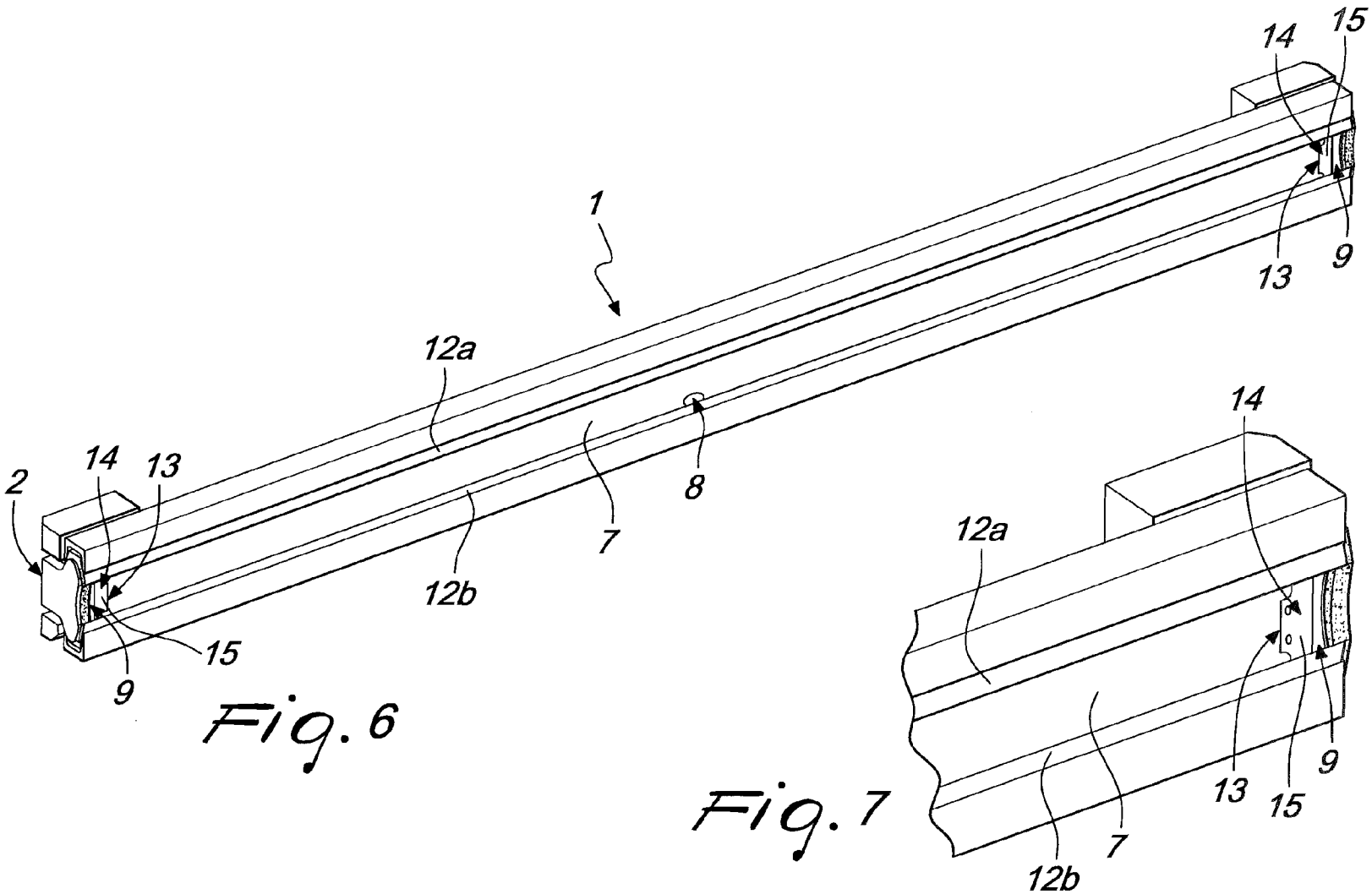
FIG. 6 is a perspective view of a variation of embodiment of the inking device according to the invention.
FIG. 7 is a detail of the variation of embodiment in FIG. 6.
Figure 8:
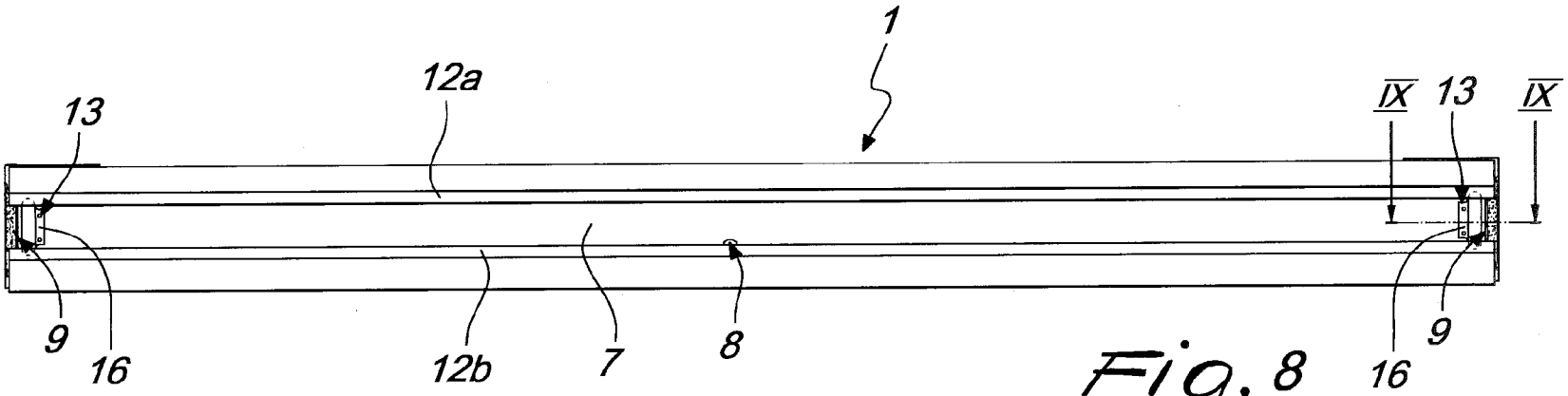
FIG. 8 is a front elevation view of the variation of embodiment in FIG. 6.
Figure 9:
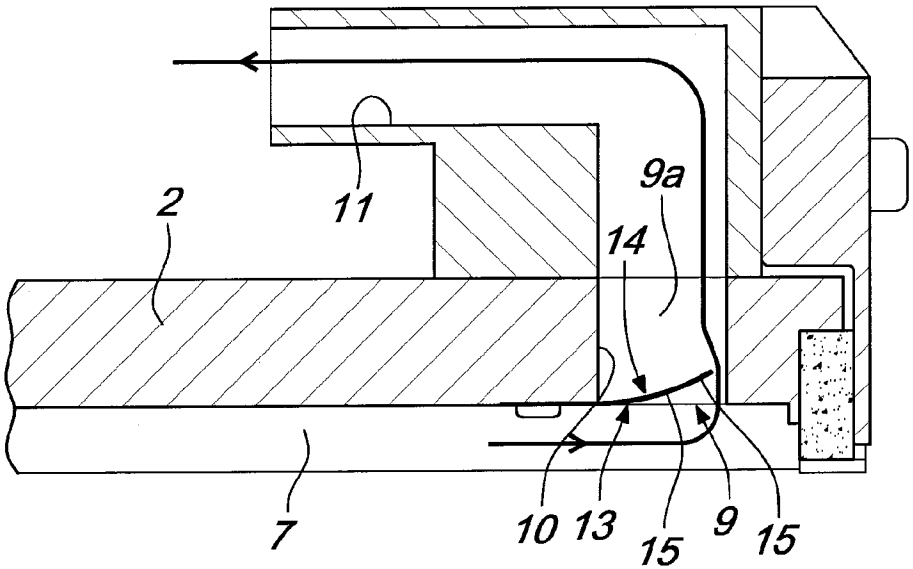
FIG. 9 is a cross-section along the line IX-IX in FIG. 8.
Figures 10, 11:
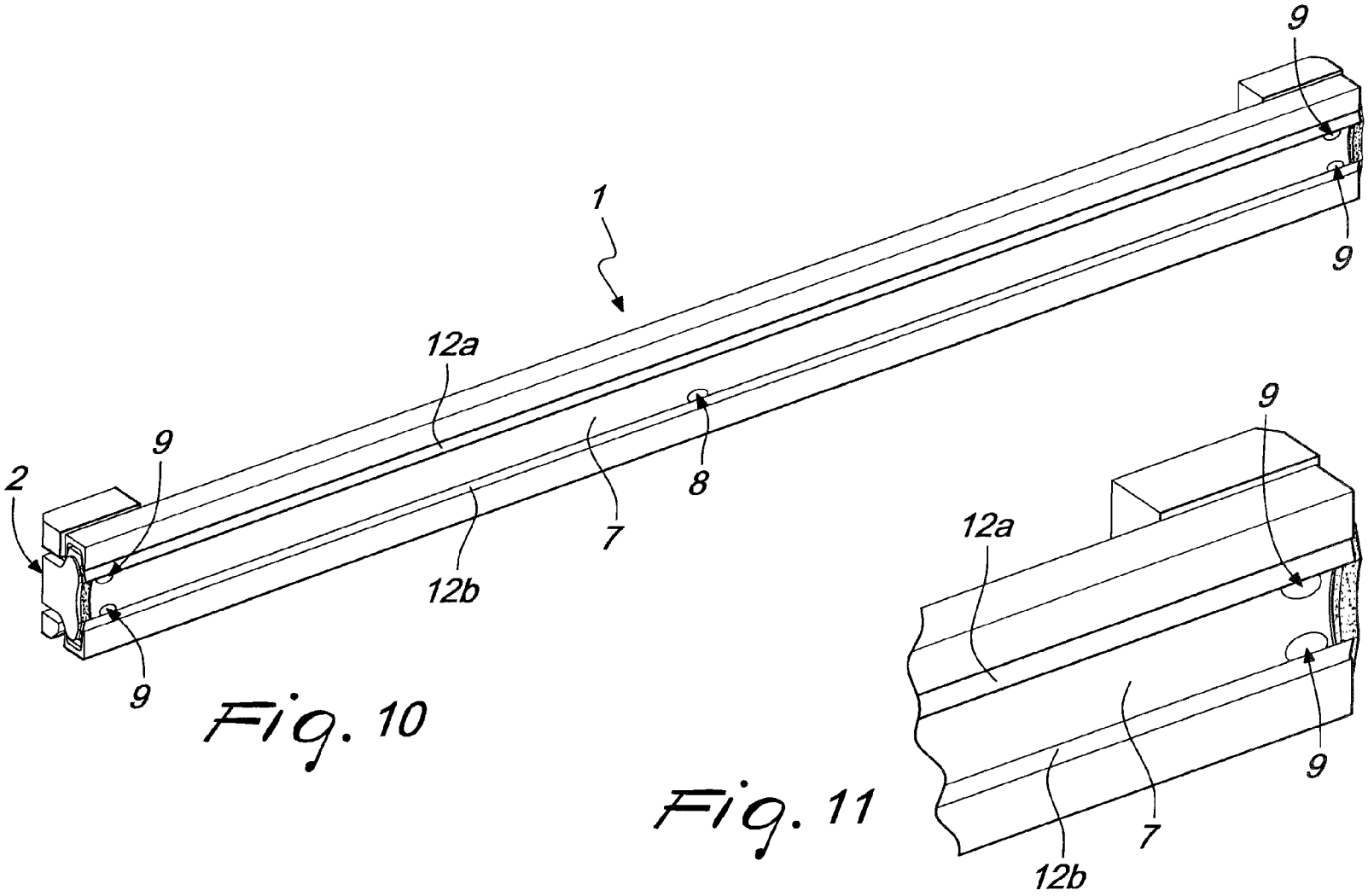
FIG. 10 is a perspective view of a third embodiment of the inking device according to the invention.
FIG. 11 is a detail of the third embodiment.
Figure 12:
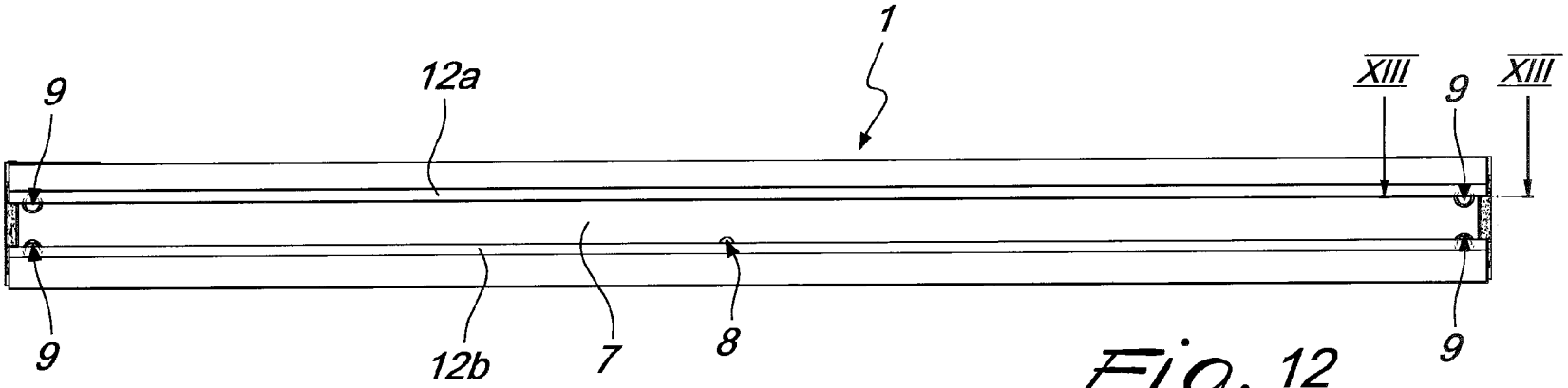
FIG. 12 is a front elevation view of the third embodiment.

As can be seen in FIG. 5, the lamina 15 is, conveniently, applied directly on the inking body 7 and held in place by the latten 16.

With this structure, when the pressure inside the inking chamber 7 increases with respect to a preset reference value considered correct for a good print result, for example owing to the pulsing of the ink supply pump, the lamina 15 bends, opening the passage openings 9*a* of the outlets 9 proportionally to the pressure of the ink inside the inking chamber 7, with the consequence that it brings about, almost instantly, a decrease in pressure inside the inking chamber 7.

Vice versa, in the event of a decrease of the pressure of the ink inside the inking chamber 7 with respect to the aforementioned reference value, the lamina 15 is brought to a position for closing the passage opening 9*a* of the ink outlets 9, thus causing, almost instantly, a rise in pressure in the inking chamber 7.

In this manner, it is possible to maintain the pressure inside the inking chamber 7 practically constant.

FIGS. 6 to 9 show a possible variation of embodiment that proposes, in essence, a solution similar to the one we have previously seen, with the sole difference that the use of the latten 16 is omitted.

It should be noted, furthermore, that the lamina 15 can also be applied in a position different from the one shown, as long as it is capable of choking the passage opening 9*a* of the corresponding outlet 9.

According to a third possible embodiment, illustrated in FIGS. 10 to 13, the flow control element 14 can be constituted by a ball element 17, which is arranged so as to at least partially intercept the respective outlet 9.

Such ball element 17 is elastically pressed, for example by way of a return spring 18, toward a sealing edge 19 that is formed by the inking body 2, around the corresponding outlet 9.

Figure 13:
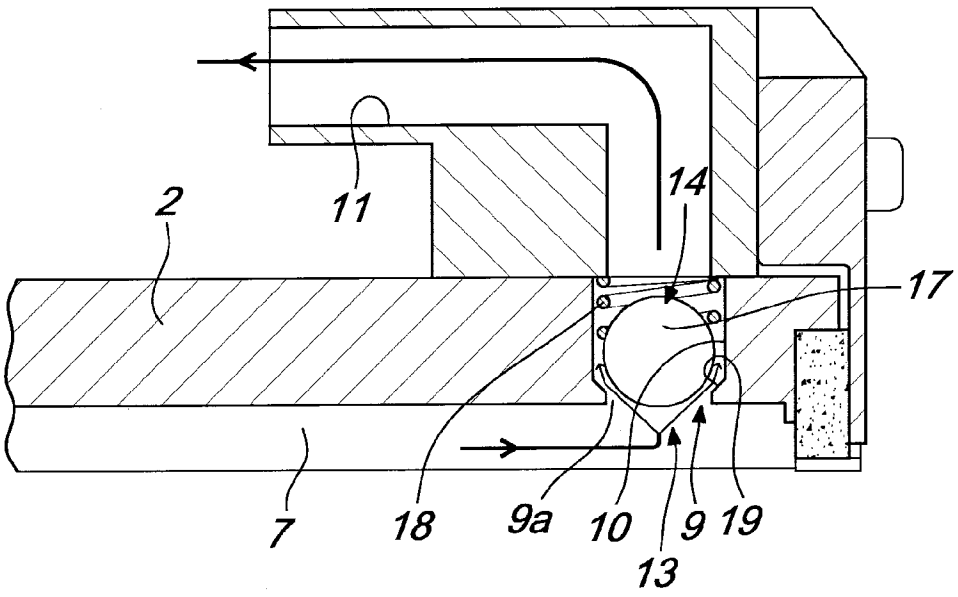
FIG. 13 is a cross-section along the line XIII-XIII in FIG. 12.

Conveniently, as can be seen in particular in FIG. 13, the ball element 17 can be installed at the discharge opening 10 of the respective outlet 9.

Also in this embodiment, a sudden increase in pressure causes the almost instantaneous transition of the ball element 17 that provides the flow control element 14 to a position for opening the corresponding outlet 9, with consequent restoration of the pressure inside the inking chamber 7 to the value essentially prior to the disturbance.

In contrast, a decrease in pressure will cause, under the effect of the return spring 18, a movement of the ball element 17 toward the sealing edge 19, with consequent transition of the ball element 17 to an at least partially closed position of the corresponding outlet 9 which again results in the restoration of the pressure conditions in the inking chamber 7 prior to the disturbance.

Similarly to what has been said previously for the previous solutions, the position in which the ball element 17 is installed in the corresponding outlet 9 is not important.

In fact, as can be seen in the embodiment shown in FIGS. 14 to 17, the ball element 17 can also be arranged along the siphon-shaped discharge channel 11 of the corresponding outlet 9.

In practice it has been found that the inking device according to the invention is capable of fully achieving the set aim in that it makes it possible to compensate for any variations of the pressure inside the inking chamber, consequently keeping the print quality constant.

All the characteristics of the invention, indicated above as advantageous, convenient or similar, may also be missing or be substituted by equivalent characteristics.

The individual characteristics set out with reference to general teachings or to specific embodiments may all be present in other embodiments or may substitute characteristics in such embodiments.

The invention, thus conceived, is susceptible of numerous modifications and variations, all of which are within the scope of the appended claims.

In practice the materials employed, provided they are compatible with the specific use, and the dimensions and shapes, may be any according to requirements.

Moreover, all the details may be substituted by other, technically equivalent elements.

The content of Italian patent application no. VR2012A000185, the priority of which is claimed in the present application, is incorporated as a reference.

The invention claimed is:

1. An inking device for printing machines, comprising an inking body, which is designed to be arranged so as to face the lateral surface of an anilox roller and forms an inking chamber that is open toward said anilox roller and has at least one inlet for introducing the ink into said inking chamber and at least one outlet for the exit of the ink from said inking chamber, further comprising control means adapted to vary a passage opening of said at least one outlet as a function of the pressure of the ink in said inking chamber, wherein said inking chamber has a longitudinal extension that is substantially parallel to an axis of said anilox roller, substantially at each one of longitudinal ends of said inking chamber at least one respective ink outlet being provided, equipped with said control means, said at least one ink inlet being arranged in an intermediate position along a longitudinal extension of said inking chamber, further comprising, at each ink outlet, a redirection wall that extends substantially parallel to the longitudinal extension of said inking chamber so as to force the flow of ink to travel along an entire length of said inking chamber.

2. The device according to claim 1, wherein said control means comprise at least one flow control element, which is arranged at said at least one outlet and can move with respect to said inking body between a position for opening said at least one outlet and a position for closing at least partially said at least one outlet.

3. The device according to claim 2, wherein said at least one flow control element is movable between said open position and said at least partially closed position of said at least one outlet in contrast to, or by the action of, elastic return means.

4. The device according to claim 2, wherein said at least one flow control element comprises an elastically flexible lamina, which is fixed at one of its ends to said inking body and cantilevers out toward the passage opening of the respective outlet.

5. The device according to claim 1, wherein said at least one outlet comprises at least one discharge opening, which is formed through said inking body and is connected to at least one respective siphon-shaped discharge channel that lies on a side of said inking body opposite to the one directed toward said anilox roller.

* * * * *